US008534998B2

(12) United States Patent
Liang et al.

(10) Patent No.: US 8,534,998 B2
(45) Date of Patent: Sep. 17, 2013

(54) CENTRIFUGAL FAN

(75) Inventors: En-Ming Liang, Shenzhen (CN); Fang-Xiang Yu, Shenzhen (CN); Jer-Haur Kuo, Tu-Cheng (TW)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 547 days.

(21) Appl. No.: 12/827,059

(22) Filed: Jun. 30, 2010

(65) Prior Publication Data

US 2011/0250065 A1 Oct. 13, 2011

(30) Foreign Application Priority Data

Apr. 9, 2010 (CN) ..... 2010 1 0143789

(51) Int. Cl.
*F04D 29/42* (2006.01)
*F04D 29/40* (2006.01)
*F03D 1/04* (2006.01)

(52) U.S. Cl.
USPC ..... 415/182.1; 415/204; 415/206; 415/207; 415/208.1; 415/212.1

(58) Field of Classification Search
USPC ..... 415/182.1, 186, 203, 204, 206, 207, 415/208.1, 211.1, 211.2, 212.1, 225, 226
See application file for complete search history.

(56) References Cited

U.S. PATENT DOCUMENTS

| | | | | |
|---|---|---|---|---|
| 5,601,400 | A * | 2/1997 | Kondo et al. | 415/119 |
| 6,917,521 | B2 * | 7/2005 | Tomioka et al. | 361/695 |
| 7,481,056 | B2 * | 1/2009 | Blaylock et al. | 60/602 |
| 2006/0021735 | A1 * | 2/2006 | Lopatinsky et al. | 165/80.3 |
| 2010/0226766 | A1 * | 9/2010 | Eguchi et al. | 415/206 |

* cited by examiner

*Primary Examiner* — Edward Look
*Assistant Examiner* — William Vadala
(74) *Attorney, Agent, or Firm* — Altis Law Group, Inc.

(57) ABSTRACT

An exemplary centrifugal fan includes a casing defining an air outlet, and an impeller in the casing. An air channel is defined in the casing between a sidewall of the casing and outermost free ends of the impeller. The sidewall includes a first curved section adjoining a second curved section. The first curved section is located at a more upstream portion of the sidewall than the second curved section along a rotation direction of the impeller. The first curved section extends along a part of an Archimedes spiral or a part of a logarithmic spiral. The second curved section is located farther away from the impeller than an imaginary extension line of the first curved section along the Archimedes spiral or the logarithmic spiral. An air guide plate is formed in the casing and extends from the air outlet to an inner region of the air channel.

12 Claims, 4 Drawing Sheets

CENTRIFUGAL FAN

BACKGROUND

1. Technical Field

The present disclosure relates to centrifugal fans, and particularly to a centrifugal fan with strong airflow.

2. Description of Related Art

Thermal modules incorporated with a centrifugal fan are often applied to dissipate heat from heat generating components, such as central procession units (CPUs) in computers. The centrifugal fan is used to provide airflow to evacuate heat from the thermal module. FIG. 4 shows a commonly used centrifugal fan 900, which includes a casing 92 and an impeller 94 received in the casing 92. The casing 92 includes a volute sidewall 922 with an air outlet 920 defined at one side thereof. As shown in the coordinate system, four regions I, II, III, IV are formed respectively at four corners of the casing 92, and the sidewall 922 includes a curved section extending from a position in the region II anticlockwise through to the 0° axis. The casing 92 defines a corner portion 924 at the region III. During operation of the centrifugal fan 900, a dead airspace is formed in the corner portion 924 of the centrifugal fan 900, wherein air in the corner portion 924 receives little or no impetus to flow towards the air outlet 920. Thus the airflow efficiency of the centrifugal fan 900 is limited.

Accordingly, it is desired to overcome the described shortcomings.

DETAILED DESCRIPTION

Figure 1:
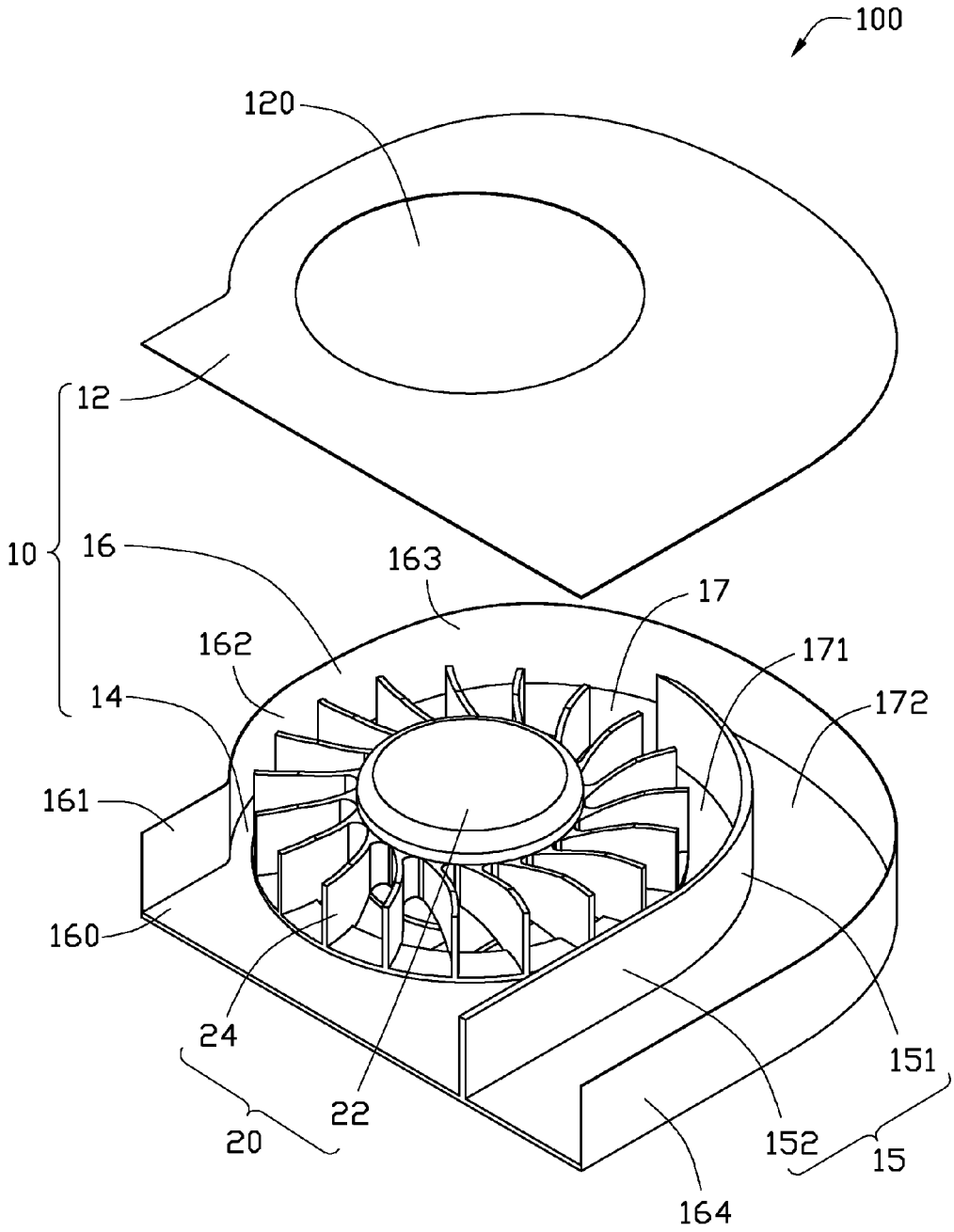
FIG. 1 is an exploded, isometric view of a centrifugal fan in accordance with an exemplary embodiment.
Figure 2:
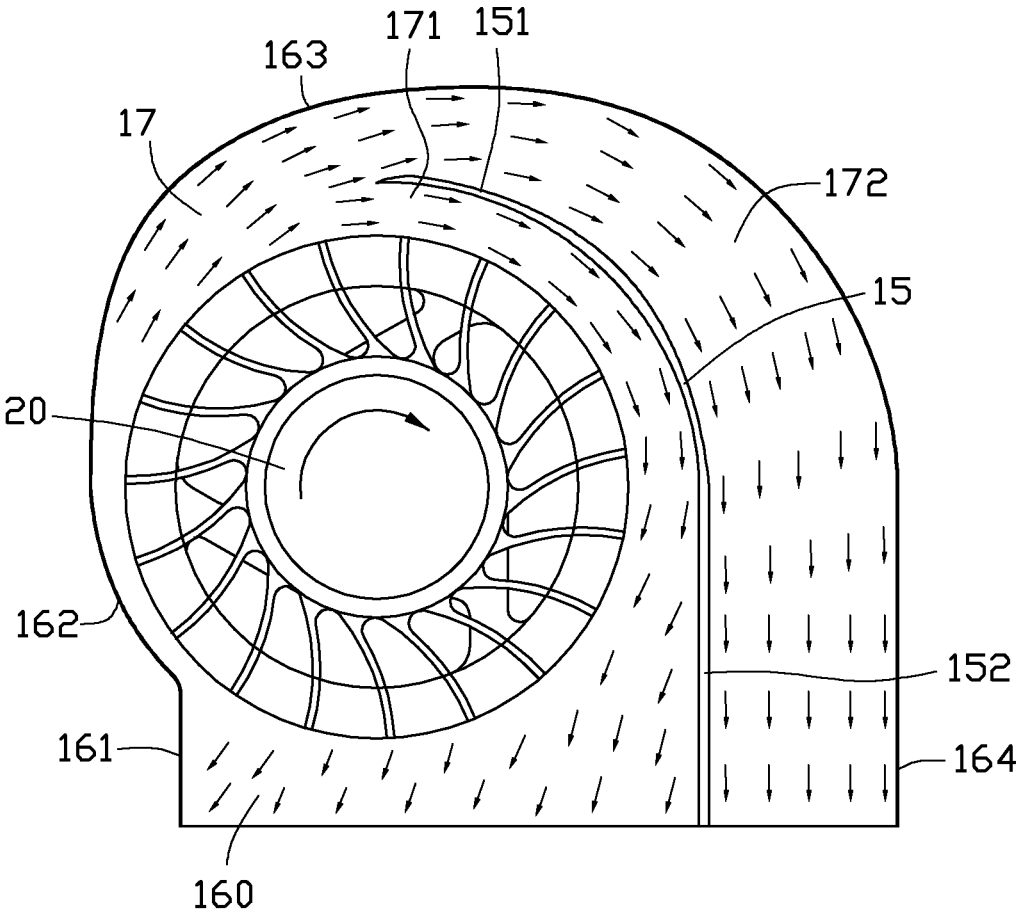
FIG. 2 is a top plan view of the centrifugal fan of FIG. 1, but omitting the cover and showing airflow paths inside the centrifugal fan.

FIGS. 1 and 2 show a centrifugal fan 100 in accordance with an exemplary embodiment. The centrifugal fan 100 includes a casing 10, and an impeller 20 received in the casing 10. The impeller 20 includes a hub 22, and a plurality of blades 24 extending radially and outwardly from an outer periphery of the hub 22. The casing 10 includes a top cover 12, a bottom plate 14 corresponding to the top cover 12, and a volute sidewall 16 interconnecting circumferential portions of the top cover 12 and the bottom plate 14. The top cover 12, the bottom plate 14 and the sidewall 16 cooperatively define a receiving space (not labeled) therein. The impeller 20 is received in the receiving space.

The top cover 12 defines a through hole 120 in a central area thereof, the through hole 120 functioning as an air inlet 120. The impeller 20 is mounted to the bottom plate 14, and aligned with the air inlet 120 of the top cover 12. The sidewall 16 extends perpendicularly upwardly from a circumference of the bottom plate 14, with an air outlet 160 defined between two ends of the sidewall 16. The impeller 20 is spaced from the sidewall 16, with an air channel 17 defined between the sidewall 16 and the outermost free ends of the blades 24 of the impeller 20.

The sidewall 16 includes, along a clockwise rotation direction of the impeller 20 as viewed in FIG. 2, a first linear section 161, a first curved section 162 connected with the first linear section 161, a second curved section 163 connected with the first curved section 162, and a second linear section 164 connected with the second curved section 163. In other words, the first linear section 161, the first curved section 162, the second curved section 163 and the second linear section 164 are connected with each other along the rotation direction of the impeller 20. An upstream end of the first curved section 162 is connected to a downstream end of the first linear section 161. A downstream end of the first curved section 162 is connected to an upstream end of the second curved section 163. A downstream end of the second curved section 163 is connected to an upstream end of the second linear section 164. The first linear section 161 and the second linear section 164 are located at two opposite sides of the air outlet 160, with the air outlet 160 defined therebetween. A width of the air channel 17 gradually increases along the rotation direction of the impeller 20.

An air guide plate 15 is perpendicularly formed on the bottom plate 14. In the present embodiment, the air guide plate 15 is integrally formed with the bottom plate 14. That is, the air guide plate 15 and the bottom plate 14 are portions of single, one-piece, monolithic body of the same material. Alternatively, the air guide plate 15 can be fixed on the bottom plate 14 after the air guide plate 15 and the bottom plate 14 have been separately formed. The air guide plate 15 extends from the air outlet 160 to approximately a midway point of the air channel 17. The midway point of the air channel 17 is located directly behind the impeller 20 far away from the air outlet 160. In particular, an imaginary line drawn perpendicularly from the air outlet 160 to the midway point of the air channel 17 passes through the center of the impeller 20. The air guide plate 15 is spaced from the sidewall 16 and the outermost free ends of the blades 24 of the impeller 20, to thereby divide a downstream portion of the air channel 17 into a first branch channel 171 and a second branch channel 172. The first branch channel 171 is located between the air guide plate 15 and the outermost free ends of the blades 24 of the impeller 20, and the second branch channel 172 is located between the air guide plate 15 and the sidewall 16. In the embodiment, the second branch channel 172 is wider than the first branch channel 171 along entire lengths of the first and second branch channels 171, 172.

Figure 3:
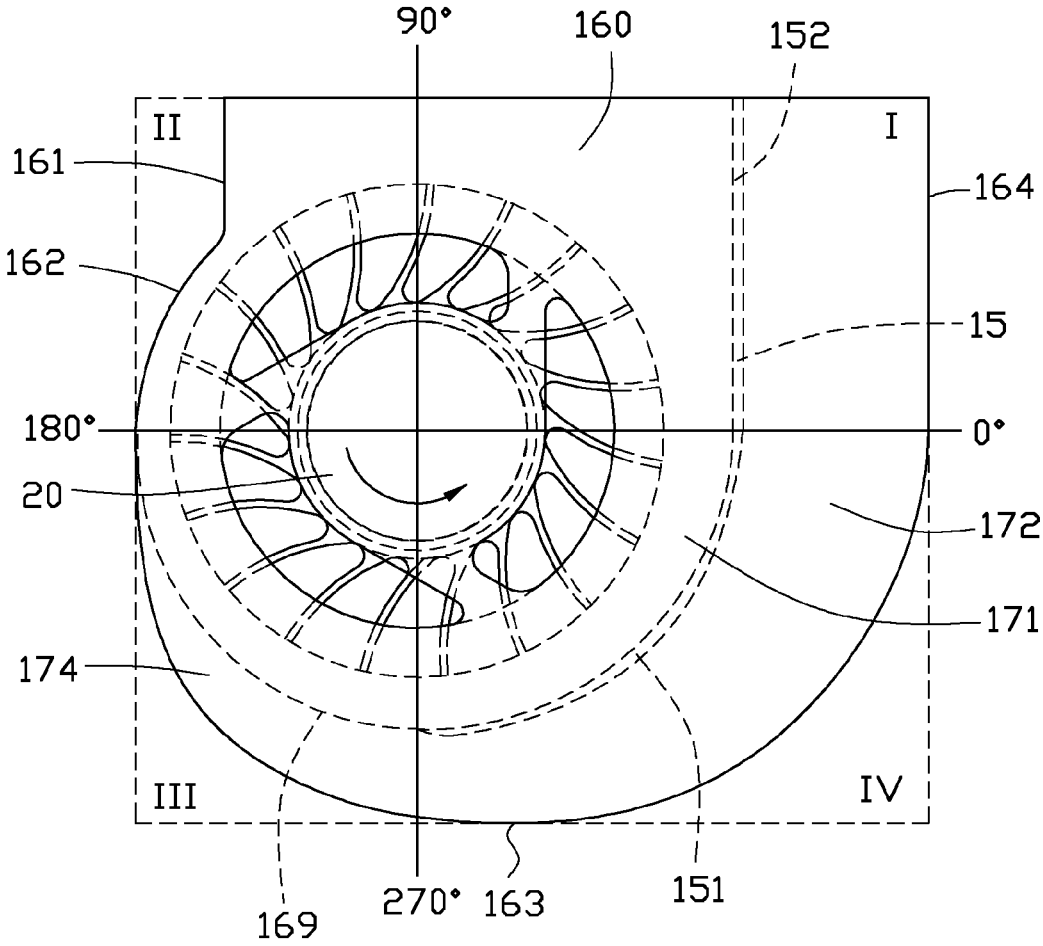
FIG. 3 is a bottom plan view of the centrifugal fan of FIG. 2.
Figure 4:
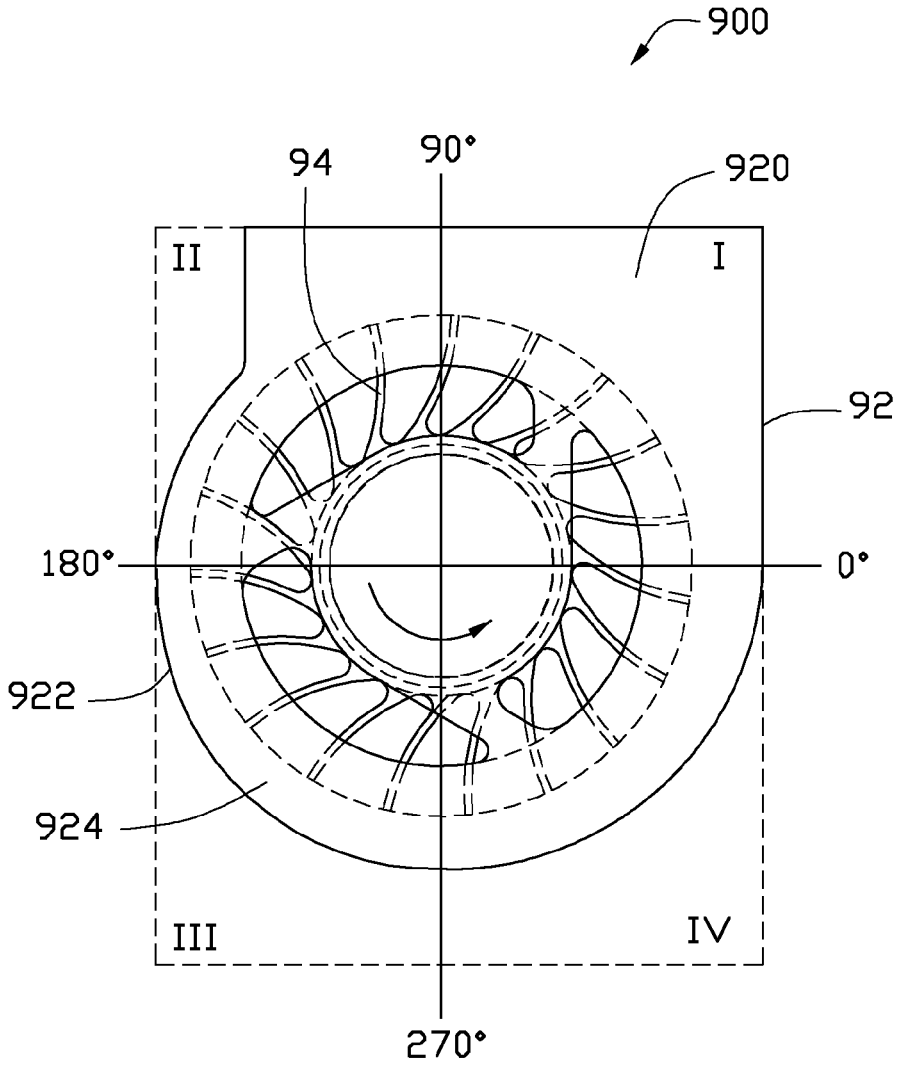
FIG. 4 (RELATED ART)
FIG. 4 is a bottom plan view of a commonly used centrifugal fan.

Referring also to FIG. 3, the centrifugal fan 100 is divided into four regions I, II, III, IV by a 0° axis, a 90° axis, a 180° axis and a 270° axis. As viewed from the bottom of the centrifugal fan 100, the first curved section 162 of the sidewall 16 is located in the region II, and extends along a part of an Archimedes spiral from the downstream end of the first linear section 161 of the sidewall 16 anticlockwise through to the 180° axis. Alternatively, the first curved section 162 of the sidewall 16 can extend along a part of a logarithmic spiral. The broken line 169 connected with the downstream end of the first curved section 162 is an imaginary extension line 169 of the first curved section 162 along the Archimedes spiral or the logarithmic spiral. The first curved section 162 together with the extension line 169 thereof coincides with the curved section of the sidewall 922 of the commonly used centrifugal fan 900 (see above). Note that in FIG. 3, the part of the extension line 169 in the region IV extending from the 270° axis to the 0° axis coincides with and is obscured by the broken lines shown for the inner section 151.

The second curved section 163 is located in the regions III, IV, and extends from the 180° axis anticlockwise through to the 0° axis. The second curved section 163 is located outside of the extension line 169 of the first curved section 162. In other words, the second curved section 163 is located farther away from the outermost free ends of the blades 24 of the impeller 20 than the extension line 169 of the first curved section 162. Thereby, a curvature of the second curved section 163 is less than that of the extension line 169 of the first curved section 162. Accordingly, the curvature of the second curved section 163 is less than that of the curved section of the sidewall 922 of the commonly used centrifugal fan 900. The casing 10 defines a corner portion 174 at approximately the middle of the air channel 17. The corner portion 174 is located in the region III corresponding to an upstream side of the second curved section 163 of the sidewall 16.

The air guide plate 15 includes an inner section 151 and an adjoining outer section 152. The outer section 152 of the air guide plate 15 extends linearly from the air outlet 160 clockwise through to the 0° axis. A free end of the outer section 152 of the air guide plate 15 is located near the center of the air outlet 160. As viewed from the bottom of the centrifugal fan 100 (FIG. 3), the inner section 151 of the air guide plate 15 curves from the 0° axis clockwise through to the 270° axis. In this embodiment, the outer section 152 of the air guide plate 15 is parallel to the second linear section 164 of the sidewall 16. The inner section 151 of the air guiding plate 15 extends to the midway point of the air channel 17. The inner section 151 of the air guide plate 15 coincides with a corresponding portion of the extension line 169 of the first curved section 162 of the sidewall 16. A width of the first branch channel 171 gradually increases along the rotation direction of the impeller 20. A width of the second branch channel 172 gradually increases from the 270° axis to the 0° axis, and remains constant from the 0° axis to the air outlet 160 along the rotation direction of the impeller 20.

The curvature of the second curved section 163 of the sidewall 16 is less than that of the curved section of the sidewall 922 of the commonly used centrifugal fan 900, thus reducing flow resistance in the air channel 17 corresponding to the second curved section 163 of the sidewall 16. Thereby, air in the corner portion 174 is efficiently guided to the air outlet 160. Accordingly, the dead airspace of the commonly used centrifugal fan 900 is mitigated or not formed at all in the centrifugal fan 100, and airflow to the air outlet 160 is thus increased. In addition, the air guide plate 15 divides airflow in the air channel 17 into two portions to respectively flow through the first branch channel 171 and the second branch channel 172, such that pressure and velocity of airflow to the air outlet 160 is increased. Furthermore, as guided by the air guide plate 15, more air may flow to portions of the air outlet 160 further away from the second linear section 164. For example, much air may flow through the first and second branch channels 171, 172 to portions of the air outlet 160 spanning from the second linear section 164 to nearly the center of the air outlet 160. Thus distribution of the airflow at the air outlet 160 can be more uniform.

It is to be understood, however, that even though numerous characteristics and advantages of the exemplary embodiment (s) have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A centrifugal fan, comprising:

a casing and an impeller received in the casing, an air channel defined in the casing between a sidewall of the casing and outermost free ends of blades of the impeller, the casing defining an air outlet at one side thereof adjacent to the sidewall, an air guide plate formed in the casing and extending from the air outlet to an inner region of the air channel, the air guide plate thereby dividing part of the air channel into two branch channels;

the sidewall comprising a first curved section adjoining a second curved section, the first curved section located at a more upstream portion of the sidewall than the second curved section along a rotation direction of the impeller, the first curved section extending along a part of an Archimedes spiral or a part of a logarithmic spiral, and the second curved section located farther away from the impeller than an imaginary extension line of the first curved section along the Archimedes spiral or the logarithmic spiral;

wherein the casing comprises a bottom plate from which the air guide plate extends, and the air guide plate is spaced from the sidewall;

wherein the midway point of the air channel is diametrically opposite from the air outlet across a middle of the impeller, the air guide plate comprises a curved inner section adjoining a linear outer section, the outer section extends from the air outlet to a first position in the air channel, and the inner section extends from the first position to the midway point of the air channel; and wherein the inner section of the air guide plate coincides with the imaginary extension line of the first curved section of the sidewall along the Archimedes spiral or the logarithmic spiral.

2. The centrifugal fan of claim 1, wherein the air guide plate is integrally formed with the bottom plate.

3. The centrifugal fan of claim 1, wherein the air guide plate is substantially perpendicular to the bottom plate.

4. The centrifugal fan of claim 1, wherein the inner region of the air channel to which the air guide plate extends is an approximate midway point of the air channel as measured along the rotation direction of the impeller.

5. The centrifugal fan of claim 1, wherein the sidewall further comprises a first linear section located at an upstream side of the first curved section and a second linear section located at a downstream side of the second curved section along the rotation direction of the impeller, and the first linear section and the second linear section are spaced from each other with the air outlet defined therebetween.

6. The centrifugal fan of claim 5, wherein the outer section of the air guide plate is parallel to the second linear section of the sidewall.

7. The centrifugal fan of claim 6, wherein the two branch channels comprise a first branch channel defined between the air guide plate and the outermost free ends of the blades of the impeller, and a second branch channel defined between the air guide plate and the sidewall, and the first branch channel widens along the rotation direction of the impeller.

8. The centrifugal fan of claim 7, wherein a width of the second branch channel first increases and then remains constant along the rotation direction of the impeller.

9. A centrifugal fan, comprising:

a casing and an impeller received in the casing, the casing defining an air outlet at a lateral side thereof, an air channel defined in the casing between a sidewall of the casing and outermost free ends of blades of the impeller, the air channel having an upstream portion and a downstream portion along a rotation direction of the impeller; and an air guide plate formed in the casing and provided in the downstream portion of the air channel, the air guide plate extending from the air outlet into the air channel until an approximate midway point of the air channel as measured along the rotation direction of the impeller and thereby dividing the downstream portion of the air channel into two branch channels;

wherein the air guide plate comprises a curved inner section adjoining a linear outer section;

wherein the sidewall comprises a first linear section and a second linear section located at two opposite sides of the air outlet, and the outer section of the air guide plate is parallel to the second linear section;

wherein the sidewall further comprises a first curved section and a second curved section located between the first linear section and the second linear section, the first curved section is located at a more upstream portion of the sidewall than the second curved section along the rotation direction of the impeller, and the second curved section adjoins a downstream end of the first curved section;

wherein the first curved section extends along a part of an Archimedes spiral or a part of a logarithmic spiral, and the second curved section is located farther away from the impeller than an imaginary extension line of the first curved section along the Archimedes spiral or the logarithmic spiral; and wherein the outer section is parallel with the second linear section, and the inner section coincides with the imaginary extension line of the first curved section along the Archimedes spiral or the logarithmic spiral.

10. The centrifugal fan of claim 9, wherein the outer section of the air guide plate extends from the air outlet to a first position in the air channel, and the inner section of the air guide plate extends from the first position to the midway point of the air channel.

11. The centrifugal fan of claim 9, wherein the casing further comprises a bottom plate from which the air guide plate extends, and the air guide plate is substantially perpendicular to the bottom plate.

12. The centrifugal fan of claim 9, wherein the air guide plate is integrally formed with the bottom plate.

* * * * *